US006727218B2

(12) United States Patent
Bargaje et al.

(10) Patent No.: US 6,727,218 B2
(45) **Date of Patent: *Apr. 27, 2004**

(54) DELIVERY OF BENEFIT AGENTS

(75) Inventors: Vijaya Milind Bargaje, Bangalore (IN); Kavitha Dhandapani, Bangalore (IN); Glyn Roberts, Bangalore (IN)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/268,498

(22) Filed: Oct. 10, 2002

(65) Prior Publication Data

US 2003/0092592 A1 May 15, 2003

(30) Foreign Application Priority Data

Oct. 12, 2001 (IN) ..... 1000/MUM/01

(51) Int. Cl.[7] ..... C11D 3/44

(52) U.S. Cl. ..... 510/417; 510/312; 510/360; 510/376; 510/407; 510/505; 510/506; 510/516

(58) Field of Search ..... 510/417, 505, 510/515, 376, 506, 360, 312, 516, 407; 8/137

(56) References Cited

U.S. PATENT DOCUMENTS

| | | | | | |
|---|---|---|---|---|---|
| 3,640,881 | A | | 2/1972 | Moussalli | |
| 4,176,080 | A | * | 11/1979 | Wise et al. | 8/137 |
| 5,112,358 | A | | 5/1992 | Deal, III | |
| 5,256,318 | A | * | 10/1993 | Masutani et al. | 252/8.57 |
| 5,648,327 | A | * | 7/1997 | Smerznak et al. | 510/340 |
| 5,705,562 | A | * | 1/1998 | Hill | 252/8.62 |
| 5,962,391 | A | | 10/1999 | Oldenhove et al. | |
| 6,224,851 | B1 | * | 5/2001 | Bara | 424/59 |
| 6,228,826 | B1 | | 5/2001 | DeYoung et al. | |

FOREIGN PATENT DOCUMENTS

| | | | |
|---|---|---|---|
| DE | 19945505 | A1 | 4/2001 |
| EP | 0620270 | A2 | 10/1994 |
| GB | 922270 | | 3/1963 |
| GB | 1545188 | | 5/1979 |
| GB | 2173508 | A | 10/1986 |
| WO | 00/36206 | | 6/2000 |
| WO | 01/90474 | | 11/2001 |
| WO | 01/90474 | A1 | 11/2001 |

* cited by examiner

*Primary Examiner*—Gregory Webb
(74) *Attorney, Agent, or Firm*—Ronald A. Koatz

(57) ABSTRACT

The present invention relates to a cleaning composition comprising an immiscible liquid system having at least one liquid-liquid interface with an interfacial tension greater than 5 mN/m. The less polar solvent in the system has a carbon chain length of at least 4, or is a silicone with more than 3 SiO units. The composition furthermore comprises from 0.001–20% by weight of a benefit agent such as a fluorescer, a dye transfer inhibitor, a fabric softening agent or an anti redeposition agent. The compositions provide for an improved delivery and efficacy of the benefit agents in e.g. a fabric cleaning process.

22 Claims, No Drawings

DELIVERY OF BENEFIT AGENTS

TECHNICAL FIELD

The invention relates to a cleaning/washing composition and to an improvement in a method or process of cleaning/washing using such cleaning/washing composition. In particular, the cleaning/washing composition is directed to provide for an enhanced delivery of benefit agents by a system of immiscible liquids with high interfacial tension.

BACKGROUND AND PRIOR ART

Conventionally fabric is cleaned using water and a detergent surfactant system which is known as wet cleaning. Surfactants adsorb on both fabric and soil and thereby reduce the respective interfacial energies and this facilitates the removal of soil from the fabric. Alternatively it is done by a process called dry cleaning where organic solvents such as perchloroethylene (PCE), petroleum based or Stoddard solvents, chlorofluorocarbon CFC-113 and 1,1,1-trichloroethane are used, all of which are generally aided by a surfactant. The organic solvent helps in the removal of oily soil in the presence of detergents. Soil removal can be achieved by a small reduction in interfacial tension. The particulate soil is largely removed by providing agitation.

It is known that the efficacy of fabric cleaning compositions can be enhanced by adding several benefit agents to the formulations such as fabric softeners, fluorescers, dye transfer inhibitors, optical brighteners etc. However, these pose a problem when formulated along with a surfactant system. Thus, for example, fabric softeners are typically cationic and suffer from instability during storage when associated with anionic detergent actives in formulations. There will also be a problem relating to the viscosity of the formulations when they are associated with ethoxylated nonionic surfactants and this problem will be more pronounced at temperatures higher than 37° C.

U.S. Pat. No. 3,640,881 (Hoechst Celanese Corp.) discloses dry cleaning compositions containing an hydrophilic optical brightener and detergent material compatible therewith to simultaneously clean and brighten textile structures and particularly white garments having a significant man-made fiber content. This technology is based in part upon the discovery that in conventional organic dry cleaning systems a water-dispersible optical brightener in the presence of a small volume of water can function as a brightness restorer preventing the textile structures, when being dry cleaned, from dulling, fading, yellowing or acquiring other undesirable characteristics. It is essential to employ a detergent material, especially of the amphoteric type, to enhance the brightening effect.

Our earlier-filed co-pending application WO-A-01/90474, published on Nov. 29, 2001, discloses a process of cleaning fabric using the liquid-liquid interface of at least two immiscible liquid phases with an interfacial tension greater than 5 mN/m, under agitation. It has been demonstrated therein that effective cleaning by this immiscible system can be achieved in the absence of other detergent actives and benefit agents.

The organic solvents used for cleaning are generally toxic and also pose other problems, as they are inflammable and hence create potential fire hazards. Another major concern in solvent cleaning is the tendency of vapour loss from the cleaning system into the atmosphere especially when they are used at elevated temperatures. Solvent cleaning processes generally employ chlorinated solvents that are linked to ozone depletion. Several attempts have been made to avoid these problems and find suitable substitutes.

Regardless of the type of solvent used, which may be water or organic, agitation of garments in the cleaning medium is essential to accelerate the removal of the soluble soil or the insoluble, particulate soil. During dry cleaning when a surfactant is used, a maximum of about 10% of water is also used along with the solvent system in order to facilitate the removal of water soluble stains.

Our copending application 999/MUM/2001, filed on Oct. 12, 2001, teaches a method of cleaning fabric using an immiscible liquid phase in which the less polar solvent has a carbon chain length greater than 6 and/or is a silicone with more than 3 SiO units to circumvent the problem of toxicity, flammability, and environmental impact whilst retaining superior cleaning of fabric.

SUMMARY OF THE INVENTION

It has now been found that the efficacy of the benefit agents used in cleaning/washing systems can be improved without encountering the problems in use of conventional surfactant systems, by the use of an immiscible liquid system having an interfacial tension greater than 5 mN/m, wherein the less polar solvent has a carbon chain length of at least 4, and or is a silicone with more than 3 SiO units.

BRIEF DESCRIPTION OF THE INVENTION

Thus according to an aspect of the present invention there is provided a cleaning/washing composition comprising:

i. an immiscible liquid system with an interfacial tension greater than 5 mN/m, wherein the less polar solvent has a carbon chain length of at least 4 and/or is a silicone with more than 3 SiO units; and ii. 0.001–20% of one or more benefit agents (as hereinafter more fully described) that is soluble in at least one of the phases.

Preferably the less polar solvent has a carbon chain length, greater than 6. It is particularly preferred that the concentration of the most polar liquid is 10.1–90% (v/v) of the immiscible system and the carbon chain length of the less polar solvent is greater than 12 and more preferably greater than 16.

In accordance with another aspect of the present invention there is provided an improved method of cleaning/washing of fabrics comprising carrying out said step of cleaning/washing under agitation using a cleaning/washing composition comprising:

i. an immiscible liquid system having an interfacial tension greater than 5 mN/m, wherein the less polar solvent has a carbon chain length of at least 4 and/or is a silicone with more than 3 SiO units, and ii. 0.001–20% of one or more benefit agents that is soluble in at least one of the phases.

DETAILED DESCRIPTION OF THE INVENTION

Thus according to the essential aspect of the present invention there is provided a fabric cleaning composition comprising an immiscible liquid system having an interfacial tension greater than 5 mN/m and one or more of said benefit agents. The delivery of the benefit agents is enhanced by the use of the immiscible liquid system. Interfacial tension may be measured using various techniques, such as sessile drop, pendant drop, spinning drop, drop volume or Wilhelmy plate method. For the purposes of the present invention, interfacial tension is measured by the Wilhelmy method, using a Kruss Processor Tensiometer K12, at 25° C.

For some systems, the interfacial tension may change whilst undergoing shearing forces typically encountered in a wash process. It is customary to refer to the interfacial tension under these conditions as a "dynamic interfacial tension" (DIFT) and this may be measured by a maximum bubble pressure technique.

Benefit Agents

The benefit agents may be selected from fluorescers, surfactants, hydrotropes, enzymes, bleaches, dye transfer inhibitors, optical brighteners, fabric softeners, anti redeposition agents, electrolytes, polymers, builders, perfumes, anti-wrinkling agents, easy-ironing agents etc. The level of these agents range between 0.001–20% by weight of the composition. The level of the fluorescers is preferably in the range 0.001–0.5%, dye transfer inhibitors in the range 0.001–1%, fabric softeners 0.001–20% and anti-redeposition agents 0.001 to 1% by weight of the composition.

Solvents

The solvents that can be used in the immiscible liquid system of the invention should be such, that the liquid immiscible system has an interfacial tension of greater than 5 mN/m. The more polar solvents can be selected from water, aromatic solvents, halogenated solvents such as chloromethane, 1,1-dichloroethane, perchloroethylene, carbontetrachloride, 1,1,2-trichloro-1,2,2-trifluoroethane, chlorobenzene, bromobenzene, heterocyclics etc, and alcohols, ethers, esters, and ketones with less than 4 carbon atoms. Preferably the more polar solvent is water. Mixtures of solvents can also be used.

The less polar solvents that have a carbon chain length of at least 4, preferably greater than 6 may be selected from branched and linear alkanes (chemical formula CnH2n+2 where n is at least 4), including but not limited to hexane, heptane, octane, nonane, decane, dodecane, tridecane, tetradecane, pentadecane etc. and mixtures thereof. Commercially available mixtures of this type include Isopar L (C11–C15 alkanes-ex-Exxon) and DF2000 (C11–C15 iso-alkanes; CAS# 90622-58-5, ex-Exxon). They may also be selected from branched and linear alkenes including but not limited to octenes, nonenes, decenes, undecenes, dodecenes etc, with one or more double bonds, and mixtures thereof.

Ethers including fluoroethers such as methoxy nonafluorobutane HFE7100 (i.e. C4F9-OCH3) and ethoxy nonafluorobutane HFE-7200 (i.e. C4F9-OC2H5); esters such as dibutyl phthalate, dioctyl phthalate, C8–C24 saturated and/or unsaturated fatty acid methyl esters, and terpenes, such as limonene, or mixtures of the above may be used. Particularly preferred esters are the C10–C18 fatty acid methyl esters such as methyl laurate, methyl myristate, methyl stearate, methyl linoleate and methyl linolenate and mixtures thereof.

The solvents with more than 3 SiO units may be selected from polydimethyl siloxane oils. Linear and cyclic siloxanes known as Lx and Dx where x is greater than three are suitable examples thereof. Specific examples include octamethylcyclotetrasiloxane (D4) (ex-Dow Corning),
decamethylcyclopentasiloxane (D5),
dodecamethylcyclohexasiloxane (D6), decamethyltetrasiloxane (L4) and dodecamethyl pentasiloxane (L5).

Agitation

Regardless of the type of solvent used, which may be water or organic, agitation of garments in the cleaning medium is essential to accelerate the removal of the soluble soil or the insoluble, particulate soil. Agitation can be provided by impellers that cover the vertical flow profile or radial flow profile or a combination of both so that thorough mixing of the immiscible liquids take place. Agitation can be provided by impellers that are of the types known as open curved turbine, turbine type propeller, axial flow turbine, flat blade turbine, inverted vane turbine, marine propeller etc. This action may also be accompanied by a tumbling action. Optionally agitation can also be provided by a combination of rotation and tumbling action. Other forms of agitation using gas jets or ultra sound may also be employed. Other forms of agitation generally known in the art can also be employed provided it ensures a good mixing of the immiscible liquid phases.

The nature of the invention, its objects and advantages will be more apparent from the ensuing description, made with relation to non-limiting examples of the above identified aspects of the invention.

EXAMPLES 1–10

EXAMPLE 1

Artificially soiled test fabric was prepared using the methodology described below and the effect of the immiscible liquids as the wash system for the delivery of benefit agents as compared with conventional aqueous detergent systems.

Preparation of the Test Fabric

Carbon soot N220, Carbot, (15 mg) was added to a 5 mg solution of sodium dodecyl sulphate in 100 ml of de-ionised water and the mixture dispersed evenly by sonication in an ultra-sound bath for a minimum of 1.5 hours. Swatches of plain white cotton 10 cm×10 cm (Poplin weave, ex Hindustan Spinning & Weaving Mills, Mumbai) were dipped into this mixture by hand until the cotton was observed visibly to be wetted completely (10–20 sec). The swatches were then withdrawn from the suspension, and allowed to drain naturally and air-dry overnight.

Determination of Detergency

The initial reflectance at 460 nm, with contribution due to UV excluded, (hereafter referred to as R460*) of swatches of this particulate soiled fabric, prepared as outlined above, was obtained using a Macbeth Colour-Eye 7000A reflectometer. For detecting fluorescer contribution, the reflectance values at 460 nm, with contribution due to UV included, (hereinafter referred to as R 460) were also obtained. Three of these swatches were placed into a 500 ml conical flask to which a test solution of 300 ml of water+0.75 grams of a detergent formulation described in Table 1, was added. The conical flask was agitated at 120 rpm for 30 mins at ambient temperature using a reciprocating agitator, which facilitates efficient mixing of the liquids. Following washing the individual swatches were air-dried and the final reflectance values for the swatches at R460* determined. The change in reflectance ΔR is determined by subtracting the initial reflectance from the final reflectance; the average change in reflectance for the three separate swatches is presented in the series of Tables set out below.

TABLE 1

| Composition by weight | % |
|---|---|
| LAS AD (linear C12-alkylbenzenesulphonate) | 25.9 |
| Fatty alcohol ethoxylates | 2.0 |
| Soda ash | 25.1 |
| Sodiumtripolyphosphate (STPP) (super white) | 33.1 |
| Silica | 4.8 |
| Sodium carboxy methyl cellulose SCMC (white grade) | 2.1 |
| Sodium hypochlorite | 0.1 |

TABLE 1-continued

| Composition by weight | % |
|---|---|
| Sodium sulphite | 0.5 |
| Sokalan CP-5 (acrylate/maleate copolymer) | 1.0 |
| Savinase/Lipolase (protease + lipase) | 0.6 |
| Perfume | 0.5 |
| Moisture to 100 | |
| Total | 100 |

i. Effect of Fluorescers on Brightness of the Fabric

The effect on detergency on adding a fluorescer, 0.0024 g/l Tinopal CBS-X, was assessed using the above procedure for the various wash systems. The data on brightness values are presented in Table 1a.

The above procedure was repeated but with the water+detergent wash medium containing 0.0024 g/l fluorescer (Example 2), water+detergent wash medium replaced with 300 ml of deionised water (Example 3) and water+detergent wash medium replaced with 300 ml deionised water and 0.0024 g/l fluorescer (Example 4), water+detergent wash medium replaced with 300 ml of a mixture of Methyl ester (CE2170 ex P&G Malaysia, CAS# 67762-40-7; a mixture of methyl laurate and methyl myristate) and water in the ratio 20:80 (Example 5), water+detergent wash medium replaced with 300 ml of a mixture of Methyl ester CE2170 and water in the ratio 20:80+0.0024 g/l fluorescer (Example 6), water+detergent wash medium replaced with 300 ml of a mixture of Soya Methyl ester (mainly C18 fatty acid methyl ester ex Columbus Foods, Chicago, USA) and water in the ratio of 20:80 (Example 7), and the water and detergent wash medium replaced with 300 ml of a mixture of Soya Methyl ester and water in the ratio of 20:80+0.0024 g fluorescer (Example 8), water and detergent wash system replaced with 300 ml of a mixture of Siloxane L5 (dodecamethyl pentasiloxane ex Dow Corning) and water in the ratio of 20:80 (Example 9), and water and the detergent wash system replaced with 300 ml of a mixture of Siloxane L5 (ex Dow Corning) and water in the ratio of 20:80+0.0024 g fluorescer (Example 10). The average change in reflectance values for these systems is reported in Table 1a.

TABLE 1a

| Example | Wash system | Detergency □R 460 |
|---|---|---|
| 1 | Detergent composition (Table 1.) | 3.9 ± 1.5 |
| 2 | Detergent composition + Fluorescer | 6.2 ± 1.4 |
| 3 | Water | 5.5 ± 1.3 |
| 4 | Water + Fluorescer | 7.5 ± 1.2 |
| 5 | Methyl ester:water 20:80 | 16.1 ± 1.6 |
| 6 | Methyl ester:water 20:80 + Fluorescer | 21.2 ± 0.6 |
| 7 | Soya Methyl ester:water 20:80 | 18.9 ± 1.5 |
| 8 | Soya Methyl ester:water 20:80 + Fluorescer | 25.6 ± 0.4 |
| 9 | Siloxane L5:water 20:80 | 16.5 ± 0.7 |
| 10 | Siloxane L5:water 20:80 + Fluorescer | 22.2 ± 0.6 |

The data presented in Table 1*a* show that the brightness of the fabric is improved significantly when the fluorescer is delivered through an immiscible system such as Soya Methyl ester:water 20:80 than when it is through a detergent formulation or pure water system.

EXAMPLES 11–18 ii. Effect on Dye Transfer Inhibition

Three 8×8 cm swatches of commercial black (vegetable dye ex Kanmani textiles Selam-Tamilnadu) cotton fabric, were placed in a 500 ml conical flask to which 300 ml of water+0.75 g of the detergent composition described in Table 2 had been added (Example 11). The initial brightness (Lba Value) was determined using a Macbeth Colour-Eye reflectometer. The conical flask was then agitated at 120 rpm for 30 minutes at ambient temperature using a reciprocating agitator, which facilitates efficient mixing of the liquids. Following washing the individual swatches were air-dried and the final brightness, E (Lba) values for washed swatches determined. The change in brightness is calculated by subtracting the final brightness from the initial brightness and the average for the three separate swatches is presented in Table 2a.

TABLE 2

| Composition by weight | % |
|---|---|
| LAS AD | 25.0 |
| Fatty alcohol ethoxylates | 2.0 |
| Soda ash | 24.3 |
| STPP (super white) | 32.0 |
| Silica | 4.6 |
| SCMC (white grade) | 2.0 |
| Sodium hypochlorite (AD bleaching) | 0.1 |
| Sodium sulphite | 0.5 |
| CP-5 | 1.0 |
| Fluorescer | 0.37 |
| Laundrosil PRT2-blue (photobleach) | 2.00 |
| Orange sodium carbonate speckles | 1.0 |
| Savinase/Lipolase | 0.60 |
| Perfume | 0.50 |
| Moisture | 4.03 |
| Total | 100.00 |

Similarly, the procedure was repeated for other wash systems such as water+0.75 detergent wash medium and 0.03 g dye transfer polymer Chromabond 100 (amphoteric polyvinyl-pyridine betaine-ex ISP, Mumbai) (Example 12), water+detergent wash medium replaced with 300 ml of deionised water (Example 13) and water+detergent wash medium replaced with 300 ml deionised water and 0.03 g dye transfer polymer Chromabond (Example 14), water+detergent wash medium replaced with 300 ml of a mixture of HFE7100 (methoxynonafluorobutane ex 3M) and water in the ratio 20:80 (Example 15), water+detergent wash medium replaced with 300 ml of a mixture of HFE7100 and water in the ratio 20:80 and dye transfer polymer Chromobond (0.1 g/l) (Example 16), water+detergent wash medium replaced with 300 ml of Methyl ester CE 1218 (a mixture of methyl laurate, methyl myristate and methyl stearate, ex P&G, Malaysia, CAS#68937-84-8) and water in the ratio 20:80 (Example 17), water+detergent wash medium replaced with 300 ml of Methyl ester CE1218 and water in the ratio 20:80 and dye transfer polymer Chromabond (0.1 g/l)(Example 18). The average inhibition of dye transfer values for these systems is reported in Table 2a.

TABLE 2a

| Example | Wash system | Dye transfer inhibition (units) |
|---|---|---|
| 11 | Detergent composition Table 2. | 16.0 ± 0.75 |
| 12 | Detergent composition + Chromabond | 11.8 ± 0.25 |
| 13 | Water | 17.7 ± 0.1 |
| 14 | Water + Chromabond | 7.8 ± 0.02 |
| 15 | HFE7100:Water 20:80 | 16.4 ± 1.3 |
| 16 | HFE7100:water 20:80 + Chromabond | 7.8 ± 0.5 |
| 17 | Methyl ester CE 1218:water 20:80 | 21.0 ± 1.7 |
| 18 | Methyl ester CE1218:water 20:80 + Chromabond | 9.2 ± 0.2 |

The data presented in Table 2a show that the dye transfer is significantly inhibited when the washing is performed using the immiscible system compared to the system containing a detergent/Chromabond. Thus in an oil/water cleaning system this polymer confers stability on dyes such as vegetable dyes.

EXAMPLES 19–29 iii. Effect of Anti Redeposition Agents

The procedure outlined in Example 1 was repeated but with the water+detergent wash medium (the composition of the detergent is given in Table 3) and 0.048 g of a soil anti-redeposition polymer SCMC (sodium carboxy methyl cellulose ex Kalpana chemicals Ltd., with a degree of substitution between 0.9–1.05 and a viscosity (2% solution) of 30–100 cP)(Example 19). Water+detergent wash medium replaced with 300 ml of deionised water (Example 20) and water+detergent wash medium replaced with 300 ml deionised water and 0.016 g/l SCMC (Example 21), water+detergent wash medium replaced with 300 ml of a mixture of HFE7100 and water in the ratio 20:80 (Example 22), water+detergent wash medium replaced with 300 ml of a mixture of HFE7100 and water in the ratio 20:80 and 0.048 g/l SCMC (Example 23). Water+detergent wash medium replaced with 300 ml of a mixture of Methyl ester CE1218 and water in the ratio 20:80 (Example 24), water+detergent wash medium replaced with 300 ml of a mixture of Methyl ester CE1218 and water in the ratio 20:80 and 0.048 g/l SCMC (example 25), water+detergent wash medium replaced with 300 ml of a mixture of Soya Methyl ester (mainly C18 fatty acid methyl ester) and water in the ratio 20:80 (Example 26), water+detergent wash medium replaced with 300 ml of a mixture of Soya Methyl ester and water in the ratio 20:80 and 0.048 g/l SCMC (example 27), water+detergent wash medium replaced with 300 ml of a mixture of Siloxane L5 ((dodecamethylpentasiloxane ex Dow Corning) and water in the ratio 20:80 (Example 28), and water+detergent wash medium replaced with 300 ml of a mixture of Siloxane L5 and water in the ratio 20:80 and 0.048 g/l SCMC (Example 29). The average change in reflectance values for these systems is reported in Table 3a.

TABLE 3

| Composition by weight | % |
|---|---|
| LAS AD | 25.5 |
| Fatty alcohol ethoxylates | 2.0 |
| Soda ash | 24.8 |
| STPP (super white) | 32.7 |
| Silica | 4.7 |
| Sodium hypochlorite (AD bleaching) | 0.1 |
| Sodium sulphite | 0.5 |
| CP-5 | 1.0 |
| Fluorescer | 0.4 |
| Laundrosil PRT2-blue | 2.0 |
| Orange speckles | 1.0 |
| Savinase/Lipolase | 0.6 |
| Perfume | 0.5 |
| Moisture | 4.2 |
| Total | 100.0 |

TABLE 3a

| Example | Wash system | Detergency □R 460* |
|---|---|---|
| 1 | Detergent composition (Table 3) | 6.0 ± 1.0 |
| 19 | Detergent composition + ARD | 6.2 ± 1.2 |
| 20 | Water | ~4.5 ± 1.1 |
| 21 | Water + SCMC | ~4.5 ± 1.0 |
| 22 | HFE7100:Water 20:80 | 20.4 ± 0.16 |

TABLE 3a-continued

| Example | Wash system | Detergency □R 460* |
|---|---|---|
| 23 | HFE7100:water 20:80 + SCMC | 23 ± 0.2 |
| 24 | Methyl ester + water | 16.1 ± 1.6 |
| 25 | Methyl ester + water 20:80 + SCMC | 19.2 ± 2.6 |
| 26 | Soya methyl ester + water | 18.9 ± 1.5 |
| 27 | Soya methyl ester + water 20:80 + SCMC | 21.5 ± 0.7 |
| 28 | Siloxane L5 + water | 16.5 ± 0.7 |
| 29 | Siloxane L5 + water 20:80 + SCMC | 18.5 ± 0.7 |

The data presented in Table 3a show that the redeposition of soil is inhibited significantly when the washing is performed using the immiscible system of oil:water (20:80), together with SCMC as compared to the system containing a detergent/SCMC or even water/SCMC alone. This demonstrates that the benefit of using an SCMC is more efficacious in the immiscible system than in the detergent system.

What is claimed is:

1. A cleaning composition comprising an immiscible liquid system comprising a polar solvent and a less polar solvent wherein a liquid-liquid interface between the polar solvent and less polar solvent has an interfacial tension greater than 5 mN/m, the less polar solvent in the system having a carbon chain length of at least 4 or being a silicone with more than 3 SiO units, characterised in that the composition comprises from 0.001–20% of one or more benefit agents which are soluble in at least one of the phases of the liquid system.

2. A composition according to claim 1, characterised in that the less polar solvent has a carbon chain length, greater than 6.

3. A composition according to claim 1, characterised in that the less polar solvent has a carbon chain length, greater than 12.

4. A composition according to claim 1, characterised in that the less polar solvent has a carbon chain length, greater than 16.

5. A composition according to claim 1, characterised in that the less polar solvent is a hydrocarbon.

6. A composition according to claim 5, characterised in that the less polar solvent is a $C_{11}$–$C_{15}$ hydrocarbon mixture.

7. A composition according to claim 1, characterised in that the less polar solvent is a fluoroether.

8. A composition according to claim 7 characterised in that the less polar solvent is methoxynonafluorobutane or ethoxynonafluorobutane.

9. A composition according to claim 7 characterised in that the less polar solvent is a $C_8$–$C_{24}$ saturated or unsaturated fatty acid methyl ester.

10. A composition according to claim 9, characterised in that the less polar solvent is a $C_{10}$–$C_{18}$ saturated or unsaturated fatty acid methyl ester.

11. A composition according to claim 1, characterised in that the less polar solvent is a polydimethyl siloxane.

12. A composition according to claim 11, characterised in that the polydimethyl siloxane is dodecamethyl pentasiloxane.

13. A composition according to claim 1, characterised in that the interfacial tension is greater than 10 mN/m.

14. A composition according to claim 1, characterised in that the interfacial tension is greater than 20 mN/m.

15. A composition according to claim 1, characterised in that the concentration of the more polar liquid ranges from 10.1–90% (v/v).

16. A composition according to claim 15, characterised in that the concentration of the more polar liquid ranges from 40–90% (v/v) for a period of at least 5 minutes when used in a cleaning process.

17. A composition according to claim 1, characterised in that the more polar liquid is water.

18. Use of a composition according to claim 1, characterised in that the benefit agent is selected from the group consisting of fluorescers, dye transfer inhibitors, fabric softeners, anti redeposition agents, and mixtures thereof.

19. A composition according to claim 18, characterised in that the level of the fluorescers is from 0.001–0.5% by weight; the level of the dye transfer inhibitors from 0.001–1% by weight, the level of the fabric softeners from 0.001–20% by weight, and the level of the anti redeposition agents from 0.001–1% by weight.

20. Use of a composition according to claim 1 in a fabric cleaning process.

21. A process for cleaning soiled fabric or soft furnishings comprising treating the soiled fabric or soft furnishing with a composition according to claim 1 under agitation.

22. A process for cleaning soiled hard surfaces comprising treating the surfaces with a composition according to claim 1 under agitation.

* * * * *